United States Patent [19]

Foulk

[11] Patent Number: 5,026,299

[45] Date of Patent: Jun. 25, 1991

[54] CHILD RESISTANT ELECTRICAL OUTLET

[76] Inventor: Donald J. Foulk, R.D. 1, Box 1145 Burrs Rd., Mt. Holly, N.J. 08060

[21] Appl. No.: 563,695

[22] Filed: Aug. 7, 1990

[51] Int. Cl.[5] ..... H01R 13/44

[52] U.S. Cl. ..... 439/137; 439/145; 439/136

[58] Field of Search ..... 439/135–142, 439/145, 373, 133

[56] References Cited

U.S. PATENT DOCUMENTS

| | | | |
|---|---|---|---|
| 4,479,688 | 10/1984 | Jennings | 439/133 |
| 4,681,384 | 7/1987 | Newman | 439/137 |
| 4,798,916 | 1/1989 | Engel et al. | 439/137 |
| 4,822,290 | 4/1989 | Cauley et al. | 439/145 |
| 4,886,465 | 12/1989 | Warner | 439/137 |

*Primary Examiner*—Paula A. Bradley

[57] ABSTRACT

A device for preventing the insertion of foreign objects into electrical outlets by infants and small children. The device is connected and secured to or replaces currently existing outlets. Internal blocking members are moved into the open position by depressing the locking buttons and sliding the blocking member away from the center of the device thus allowing electrical plugs to be inserted into the device. When a plug is removed from the device the corresponding blocking member is automatically forced into the closed position by internal springs. While in the closed position the openings for the plug are completely blocked preventing the insertion of objects into the openings and the locking buttons automatically engage in the locked position preventing movement of the blocking member until the locking buttons are depressed again.

10 Claims, 2 Drawing Sheets

FIG. 4
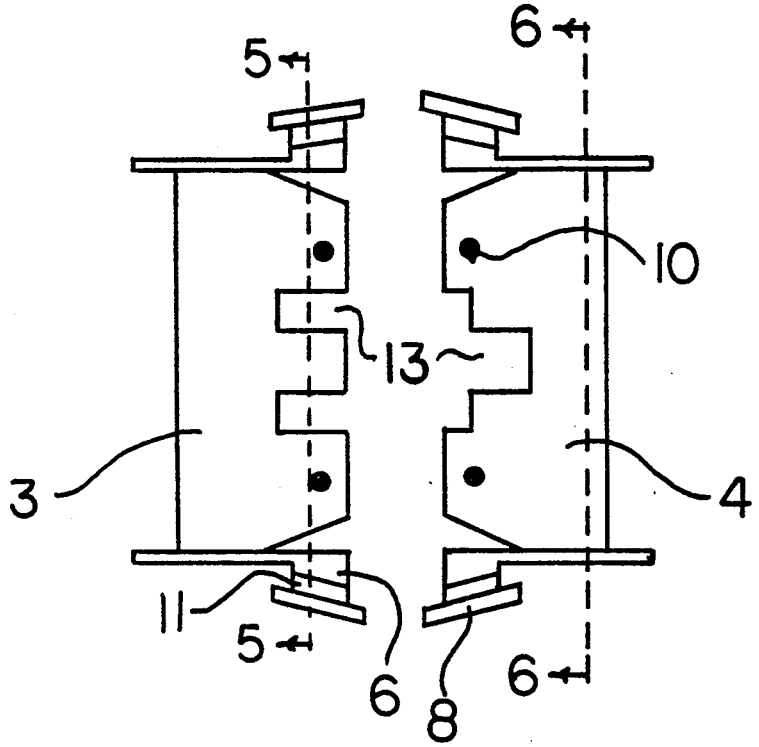
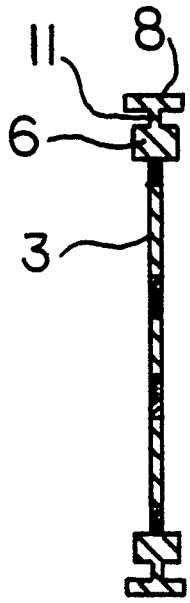
FIG. 5
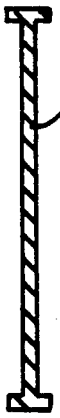
FIG. 6

CHILD RESISTANT ELECTRICAL OUTLET

BACKGROUND OF THE INVENTION

1. Field of the Invention

The invention relates generally to a device for replacing or affixing to currently existing electrical outlets in order to prevent the inspection of foreign objects into electrical outlets by infants and small children.

2. Description of the Prior Art

Current methods consist of blocking devices or covers which must be removed and replaced when the outlet is placed in and taken out of service. Other devices that do remain fixed to the outlet and automatically close when the outlet is taken out of service do not lock in the closed position and often still allow enough opening for the insertion of small objects such as paper clips.

SUMMARY OF THE INVENTION

The invention relates to a device for preventing infants and small children from inserting foreign objects into electrical outlets. It accomplishes this via a integral automatically closing and locking blocking mechanism.

It is the object of this invention to provide an inexpensive permanently affixed, self maintaining device for preventing the insertion of foreign objects by infants and small children into electrical outlets.

BRIEF DESCRIPTION OF THE DRAWINGS

Referring to the drawings:

FIG. 4 is a frontal view of the left and right blocking members, FIG. 5 is a sectional view of the left blocking member along section 5—5 of FIG. 4, FIG. 6 is a sectional view of the right blocking member along section 6—6 of FIG. 4.

DESCRIPTION OF THE PREFERRED EMBODIMENT

Figure 1:
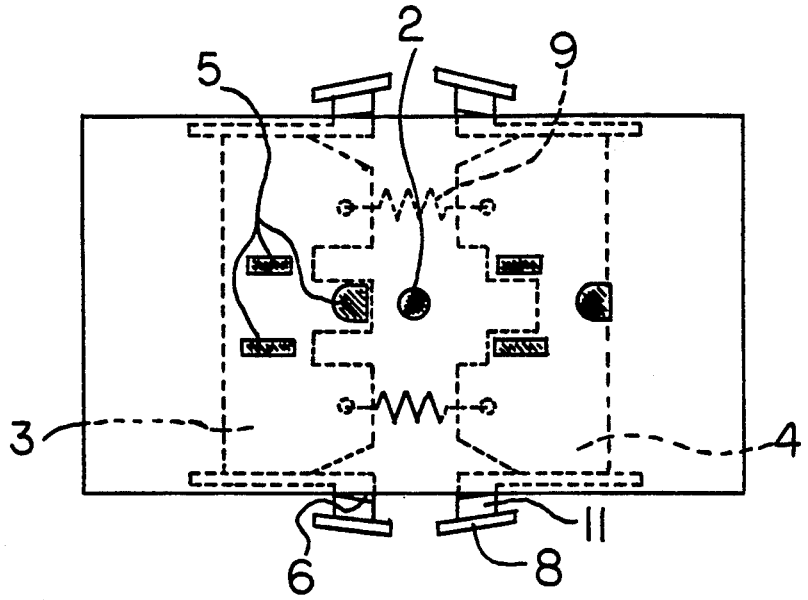
FIG. 1 is a frontal view of an embodiment of the "Child Resistant Electrical Outlet, "
Figure 2:
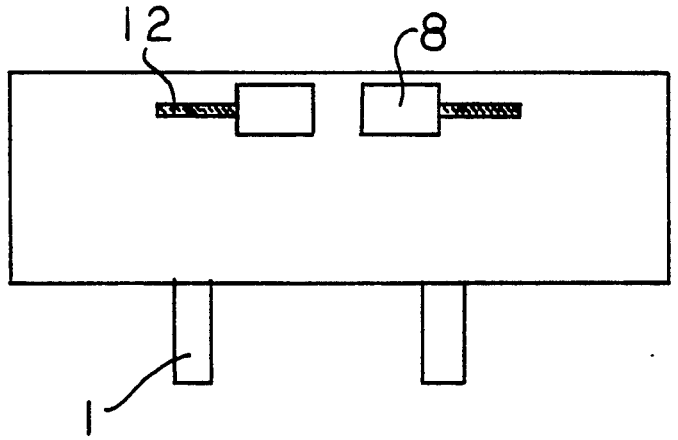
FIG. 2 is a side view of an embodiment of the "Child Resistant Electrical Outlet,"
Figure 3:
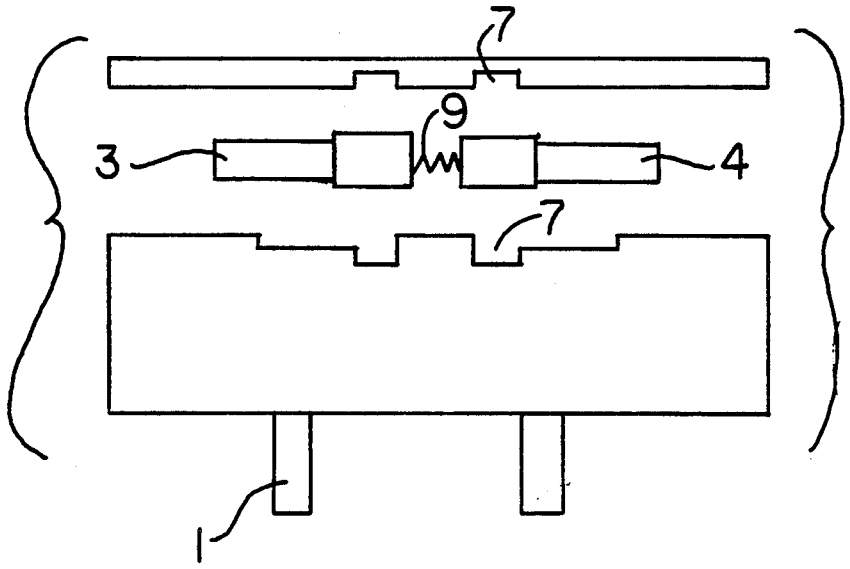
FIG. 3 is an exploded side view of an embodiment of the "Child Resistant Electrical Outlet" which exposes the internal blocking members and return springs.

Referring to FIGS. 1, 2 and 3 an embodiment of the child resistant outlet is shown. The connecting prongs (1) are inserted into a currently existing electrical outlet and the child resistant electrical outlet is secured in place by a screw which is inserted through the screw hole (2) and threaded into the screw hole in the existing electrical outlet.

Within the child resistant electrical outlet is a left blocking member (3) and a right blocking member (4) which prevent foreign objects from entering through the outlet openings (5) while in the closed position.

Each blocking member has two locking buttons (6) which protrude through enlarged openings (7) in the side of the child resistant electrical outlet, preventing movement of the blocking member from the closed position unless both button heads (8) are depressed. Depressing both button heads (8) on a blocking member allows the blocking member to be moved away from the center of the child resistant electrical outlet into the open position, allowing the insertion of an electrical plug or appliance into the outlet openings (5).

As each blocking member is moved toward the open position tension is applied by the return springs (9) thus drawing the blocking members into the closed position when the blocking member is released or when an electrical plug is disconnected from the child resistant electrical outlet.

As each blocking member returns to the closed position the locking buttons (6) automatically reengage in the locked position.

Referring to FIG. 4 detailed view of the left blocking member (3) and the right blocking member (4) are shown. Note two holes in each blocking member used to attach return springs (9) from left blocking member (3) to right blocking member (4).

Referring to FIG. 5 a sectional view of the left blocking member (3) along section 5—5 is shown. This Figure illustrates the locking button mechanism in more detail. As the button head (8) is depressed the narrow section (11) aligns with the slot (12) along the side of the child resistant electrical outlet allowing the blocking member to be moved to the open position.

Referring to FIG. 6 a sectional view of the right blocking member (4) along section 6—6 is shown. This view illustrates the shape and dimension of the blocking members at the end opposite the locking button mechanism.

Both left blocking member (3) and right blocking member (4) are identical in construction except for the cut-outs (13) which must be different to allow for proper alignment with the outlet openings (5) while the blocking members are in the open position.

I claim:

1. A child resistant electrical outlet which comprises:

(a) a means for conducting electrical current from an existing electrical outlet to electrical appliance plugs while the plugs are inserted in the child resistant electrical outlet;

(b) a means for securing to existing electrical outlets in such a manner to prevent easy removal by infants and children;

(c) a blocking device to prevent insertion of objects into the child resistant electrical outlet while not in use;

(d) a means for automatically closing the blocking device when the outlet is taken out of service;

(e) a mechanism for automatically locking the blocking device in the closed position while the child resistant electrical outlet is not in service.

2. A child resistant electrical outlet as cited in claim 1 in which the blocking device comprises movable internal blocking members.

3. A child resistant electrical outlet as cited in claim 2 in which the locking mechanism is an integral part of the movable internal blocking member.

4. A child resistant electrical outlet as cited in claim 3 in which the means for automatically closing the blocking members comprises a spring or springs used to force the blocking members toward the closed position at all times.

5. A child resistant electrical outlet as cited in claim 4 in which the means for locking the blocking members in the closed position comprises two locking push buttons on each blocking member.

6. A child resistant electrical outlet as cited in claim 5 in which the locking push buttons comprise:

(a) a spring mechanism to allow depression of the locking button when the blocking member is to be moved into the open position and to return the locking button to the undepressed position automatically when the blocking member returns to the closed position;

(b) a wide section which protrudes through an enlarged opening in the outer shell of the child resistant electrical outlet when the blocking member is in the closed position therefore preventing any movement of the blocking member until the locking buttons are depressed;

(c) a narrow section which aligns with a narrow slot in the outer shell of the child resistant electrical outlet when the locking button is depressed, allowing the blocking member to be moved to the open position when both buttons are depressed;

(d) a head which protrudes through the outer shell of the child resistant electrical outlet at all times and is used to depress the locking buttons and move the blocking member to the open position when needed.

7. A child resistant electrical outlet as cited in claim 6 in which the means for securing to the existing outlet comprises a screw which is inserted through a screw hole in the child resistant electrical outlet and threaded into an existing hole in the existing electrical outlet.

8. An improved electrical outlet wherein the improvement comprises:

(a) a blocking device to prevent the insertion of objects into the electrical outlet while not in use which comprises movable internal blocking members; and (b) a means for automatically closing the blocking device when the electrical outlet is taken out of service which comprises a spring or springs used to force the blocking members toward the closed position at all times; and (c) a mechanism, which is an integral part of the movable blocking members, for automatically locking the blocking device in the closed position while the electrical outlet is not in service.

9. An improved electrical outlet as cited in claim 8 in which the means for locking the blocking members in the closed position comprises two locking push-buttons on each blocking member.

10. An improved electrical outlet as cited in claim 9 in which the locking push button comprise:

(a) a spring mechanism to allow depression of the locking push-button when the blocking member is to be moved into the open position and to return the locking push-button to the undepressed position automatically when the blocking member returns to the closed position; and (b) a wide section which protrudes through an enlarged opening in the outer shell of the improved electrical outlet when the blocking member is in the closed position therefore preventing any movement of the blocking member until the locking push-buttons are depressed; and (c) a narrow section which aligns with a narrow slot in the outer shell of the improved electrical outlet when the when the locking push-button is depressed, allowing the blocking member to be moved to the open position when both locking push-buttons are depressed; and (d) a head which protrudes through the outer shell of the improved electrical outlet at all times and is used to depress the locking buttons and move the blocking member to the open position as needed.

* * * * *